United States Patent [19]

Boyer et al.

[11] 4,255,823

[45] Mar. 17, 1981

[54] APPARATUS FOR MOVING AND/OR TRANSPORTING LOADS

[75] Inventors: Adrian J. Boyer, "Oakbank", Minore Rd., Via Dubbo, New South Wales 2830; William R. Richardson, 19 Allison St., Dubbo, New South Wales 2830; Robert J. Metcalfe, 107 Kissing Point Rd., Turramurra, New South Wales 2073; Peter J. Foden, East Brighton, all of Australia

[73] Assignees: Adrion J. Boyer, Via Dubbo; William R. Richardson, Dubbo; Robert J. Metcalfe, Turramurra, all of Australia

[21] Appl. No.: 22,440

[22] Filed: Mar. 21, 1979

[51] Int. Cl.[3] ..... A47B 83/04; A61G 1/02

[52] U.S. Cl. ..... 5/81 R; 5/86; 4/562; 280/47.16

[58] Field of Search ..... 5/81 R, 86, 87; 4/185 R, 185 L; 280/47.16; 254/148; 214/1 A, 9 R, 17, 75 R

[56] References Cited

U.S. PATENT DOCUMENTS

| | | | |
|---|---|---|---|
| 2,869,614 | 1/1959 | Wansly | 5/81 R |
| 2,962,730 | 12/1960 | Garnes et al. | 5/81 R |
| 3,270,353 | 9/1966 | Berthelsen et al. | 5/81 R |
| 3,407,413 | 10/1968 | James | 5/81 R |
| 3,829,916 | 8/1974 | James | 5/81 R |
| 3,940,808 | 3/1976 | Pitrini | 5/81 R |
| 3,964,786 | 6/1976 | Mashuda | 5/81 R |
| 3,981,484 | 9/1976 | James | 5/81 R |

*Primary Examiner*—Casmir A. Nunberg

*Attorney, Agent, or Firm*—Merchant, Gould, Smith, Edell, Welter & Schmidt

[57] ABSTRACT

A transporter for handling invalids and the like capable of lifting patients off a bed, move them on to a toilet, move them into a bath or move them into a motor vehicle. The transporter comprises a wheeled base frame having mounted thereon means for holding a patient above the base frame. This holding means comprises lifting means for moving the patient up and down and pivot means for moving the patient in a horizontal plane.

24 Claims, 10 Drawing Figures

APPARATUS FOR MOVING AND/OR TRANSPORTING LOADS

This invention relates to apparatus for moving and/or transporting patients, invalids or other incapacitated persons, hereinafter generally called "patient".

Various forms of apparatus of this type are known such as trolleys and wheel chairs which have adjustments such as lifting mechanisms, but they suffer from the defect that the upright holding means that supports the lifting mechanism is placed centrally of the supporting base frame of the apparatus and hence is in a direct fore-and-aft line with the patient. Because of stability considerations, this results in restriction of movement of the patient and hence the restrictions in the type of places into which the apparatus can be manoeuvred and the type of operations that can be performed.

The above disadvantages are overcome by the apparatus of the invention. The apparatus is for use with a patient support structure and comprises a patient transporter comprising a base frame, wheels or the like fitted to the base frame to support it for movement in at least fore-and-aft directions; and holding means mounted on the base frame to hold the patient support structure above the base frame characterized in that the holding means is mounted at one side of the base frame relative to the fore-and-aft directions and wherein the holding means comprises lifting means operable in use of the transporter to raise and lower the patient support structure relative to the base frame and pivot means to allow horizontal rotation of the patient support structure between positions in which it is aligned with or transverse to the said fore-and-aft directions.

The most essential functions required by a patient handling apparatus are as follows:

(a) moving a patient onto and off a bed (b) toileting a patient (c) bathing a patient and (d) moving a patient in and out of a motor vehicle.

It is possible with the apparatus of the present invention to achieve any one or more of the abovementioned functions. In addition to the foregoing the apparatus will act as a normal wheel-chair.

The invention will now be described with respect to the accompanying drawings in which.

Figure 1:
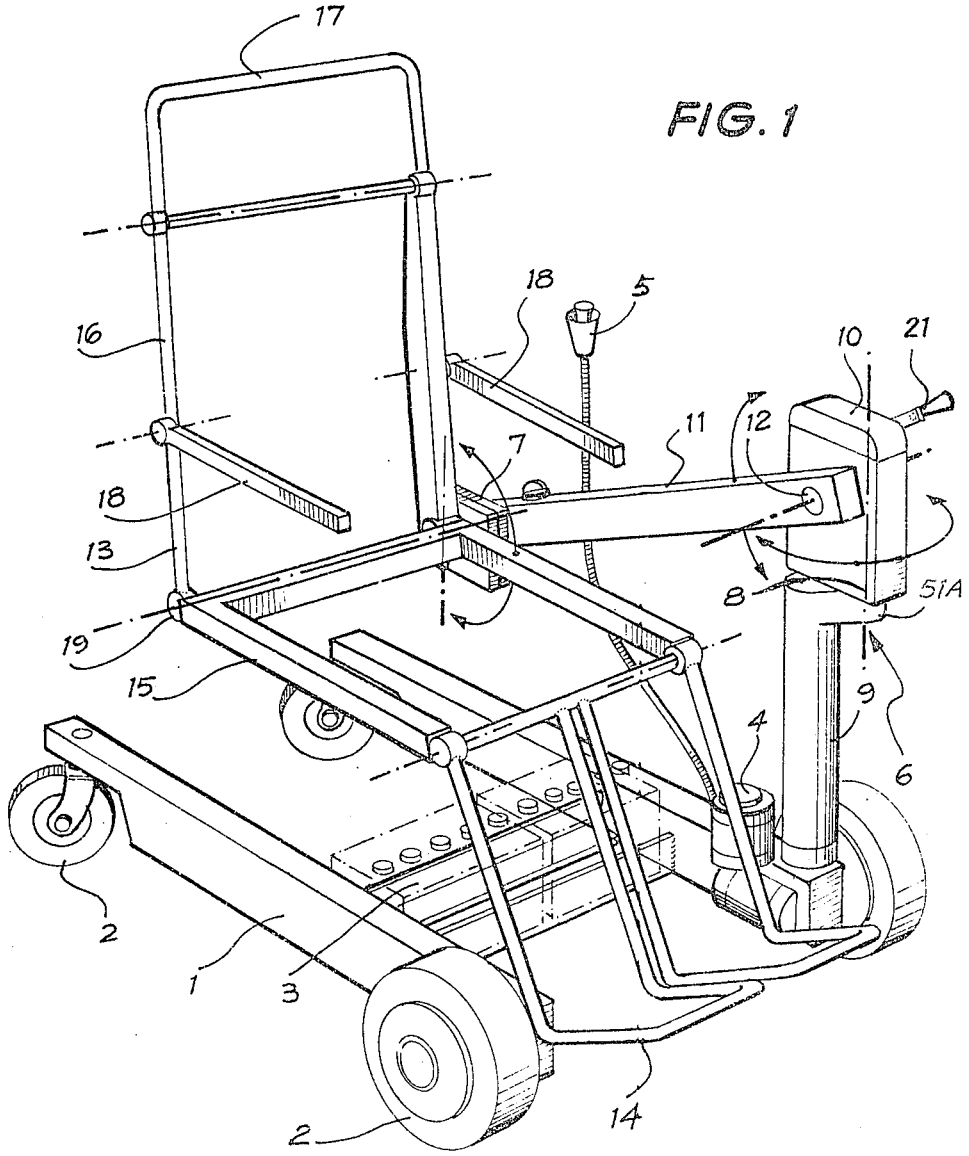
FIG. 1 illustrates one embodiment of the invention showing the position of the normal wheel-chair operation.

In FIG. 1 the base frame 1 is supported by wheels 2 which wheels are adapted to at least move the apparatus in a fore-and-aft direction. In an electrically operated apparatus batteries 3 may be attached to the frame 1 to drive one or more motors such as 4 by means of a control arrangement 5. This control arrangement 5 may be attached to the apparatus for use by the patient being carried or it may be detached from the apparatus and remotely used by an attendant.

Figure 8:
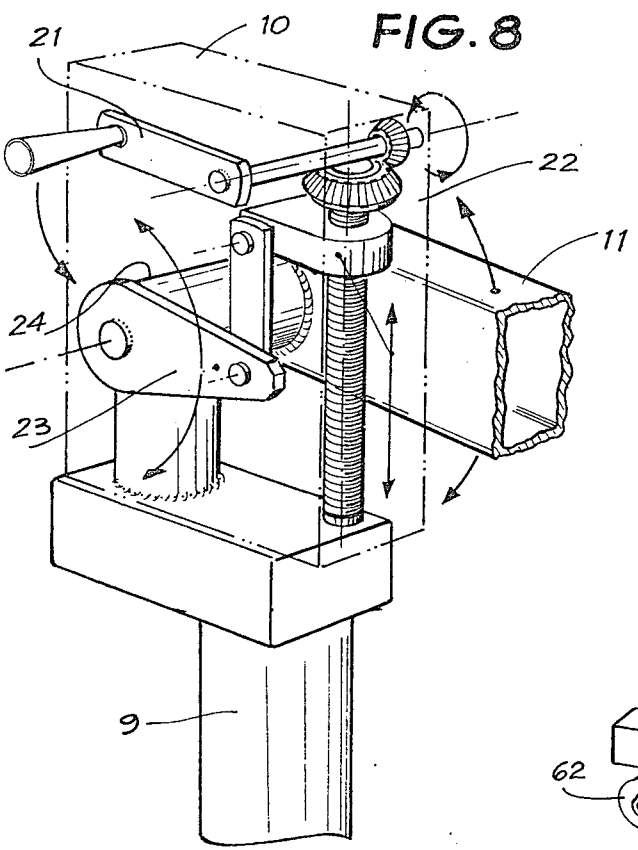
FIG. 8 illustrates a form of lifting apparatus.

Mounted towards one side of the frame is a holding means 6. This holding means comprises lifting means such as shown in FIG. 8 and pivot means shown at 8.

In this embodiment the holding means comprises an upstanding post 9 rotatably attached to which is the lifting means housing 10. Moving means comprising the arm 11 which is attached at one end to the lifting means and rotated by the lifting means about the pivot point 12. To the other end of the arm 11 is attached a pivot 7 in the form of a hinge one leaf of which is affixed to the arm 11 and the other leaf is adapted for attachment either fixedly or detachably to the patient support structure, which in this case is an articulated stretcher 13.

The stretcher 13 may take any suitable form depending on the type of patient to be carried. The general purpose stretcher is shown which has two leg portions 14 each of which may be independently adjusted for length and which are adjustably attached to seat portion 15 which is adjustably attached to a back portion 16 which is adjustably attached to a head portion 17. Arms 18 are rotatably affixed to the body portion so that they may be used as arm-rests as shown or fitted along the sides of the body portion during operation as a stretcher. The arms 18 may have mechanical or electrical attachments whereby movement of them by the patient may move the body portion 16 with respect to the seat portion 15 about a pivot point 19 thus adjusting the patient's position.

Figure 2:
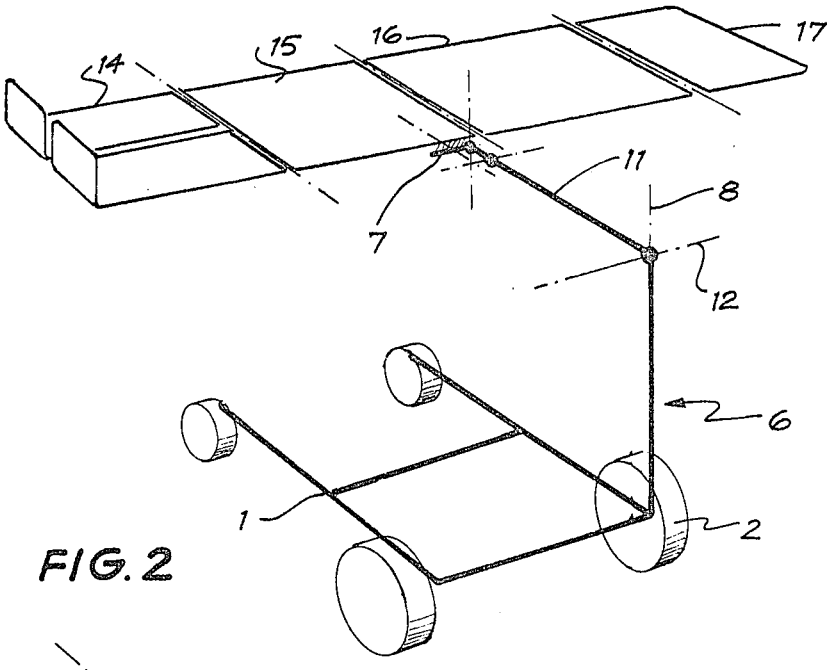
FIG. 2 illustrates schematically the position of apparatus for transferring a patient to or from a bed.
Figure 3:
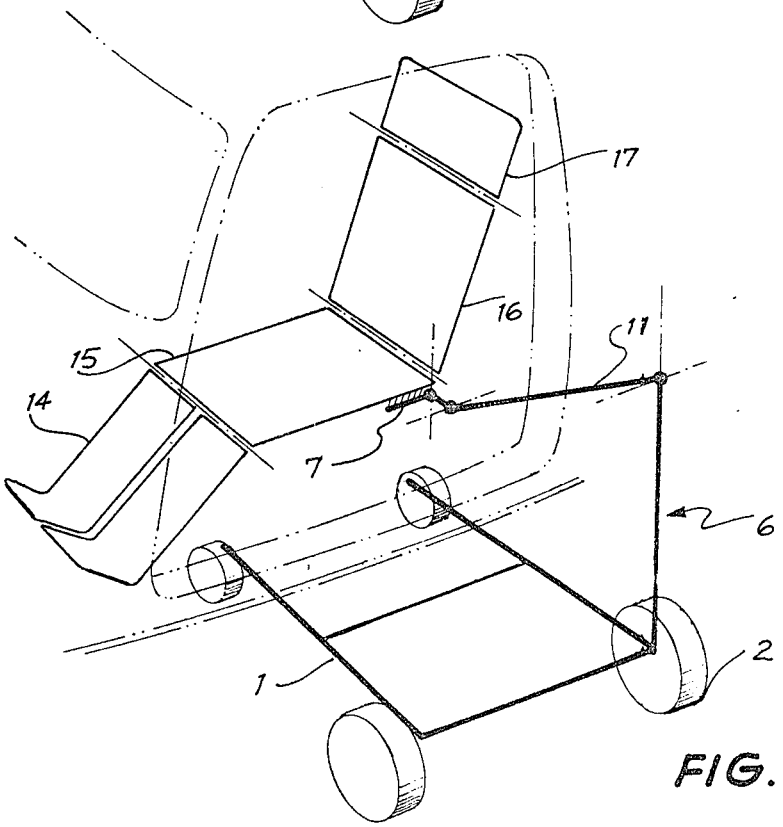
FIG. 3 illustrates schematically the movement in and out of a motor vehicle.

In operation, the hinge 7 can be open through 90° so that the stretcher is in the position shown in FIGS. 2 or 3.

In FIG. 2 this position is used for lifting the patient on and off a bed. The base and wheels are easily positioned under the bed and the stretcher is positioned on the bed by adjusting the lifting means as in FIG. 8 which adjusts the height of the arm 11. The patient can then be rolled onto the stretcher and the apparatus used to move the patient elsewhere. Usually for moving through doorways and the like the hinged pivot 7 is moved through 90° so that the stretcher is positioned fore-and-aft as shown in FIG. 5.

Figure 5:
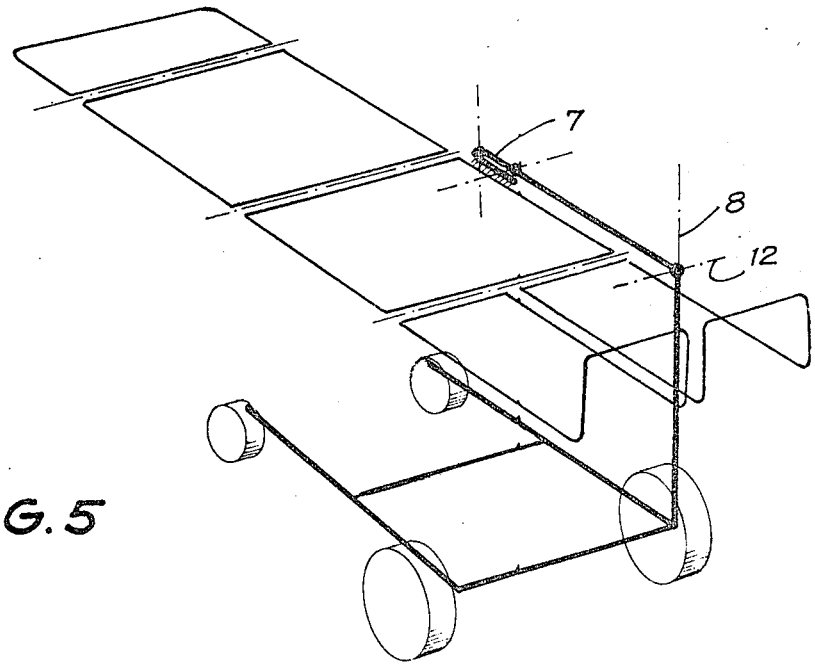
FIG. 5 illustrates schematically the patient support structure or stretcher in a fore-and-aft position.

The patient can be moved about in the FIG. 5 position or the stretcher can be altered to the chair position as shown in FIG. 1. The base frame as shown in FIG. 1 is U-shaped so that it can be fitted around a toilet so the position shown in FIG. 1 is also used for toileting the patient as well as normal wheel-chair operation.

Figure 4:
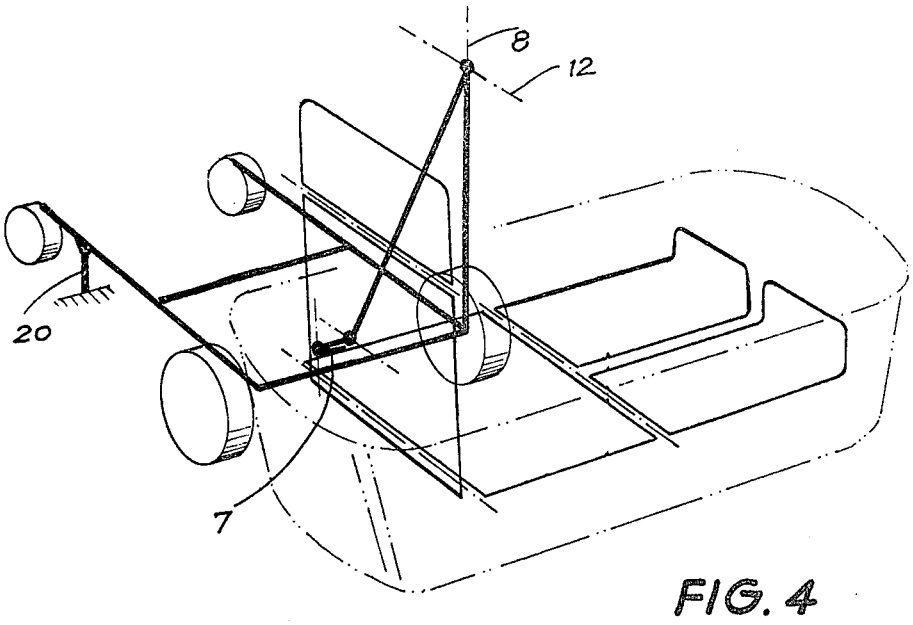
FIG. 4 illustrates schematically the movement in and out of a bath.

In the bathing operation as shown in FIG. 4 the arm 11 is pivoted through 90° about the pivot 8 while the hinge 7 is kept in the closed position as in FIG. 5. The stretcher has the back portion 16 and head portion 17 raised to a sitting position and the base frame is wheeled close to the bath and anchored by anchor 20 (FIG. 4) at its end remote from the bath. With the arm 11 in sufficiently high position it is swung around the pivot 8 until the stretcher is over the bath. This is possible by virtue of the off-set 51A in the holding means. The lifting means is then operated to lower the stretcher into the water in the bath. After bathing the arm 11 is raised and then pivoted about the pivot 8 to bring the apparatus in the fore-and-aft position of FIG. 5. The patient can then be wheeled from the bathroom.

The holding means 6 incorporates lifting means of any suitable type for pivoting the arm 11 about the pivot 12 so that the hinge 7 end of the arm can be raised or lowered. The lifting means may comprise rack and pinion, worm-gears, hydraulic rams, etc. Any of these means may be electrically operated with the operation performed by the patient or an attendant. One such lifting means is illustrated in FIG. 8.

The upstanding post 9 which may be detached from the base frame 1 has a lifting means housing 10 mounted thereon for rotation about pivot 8. The crank 21 when turned by hand rotates gears 22 and linkage 23 to thereby rotate shaft 24 to which the arm 11 is attached. Arm 11 rotates in unison with the rotation of shaft 24.

Figure 7:
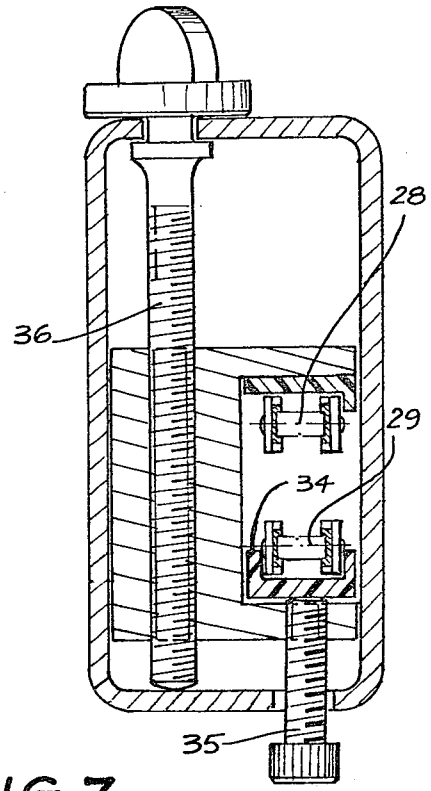
FIG. 7 illustrates adjustment means for the levelling arrangement of FIG. 6.
Figure 6:
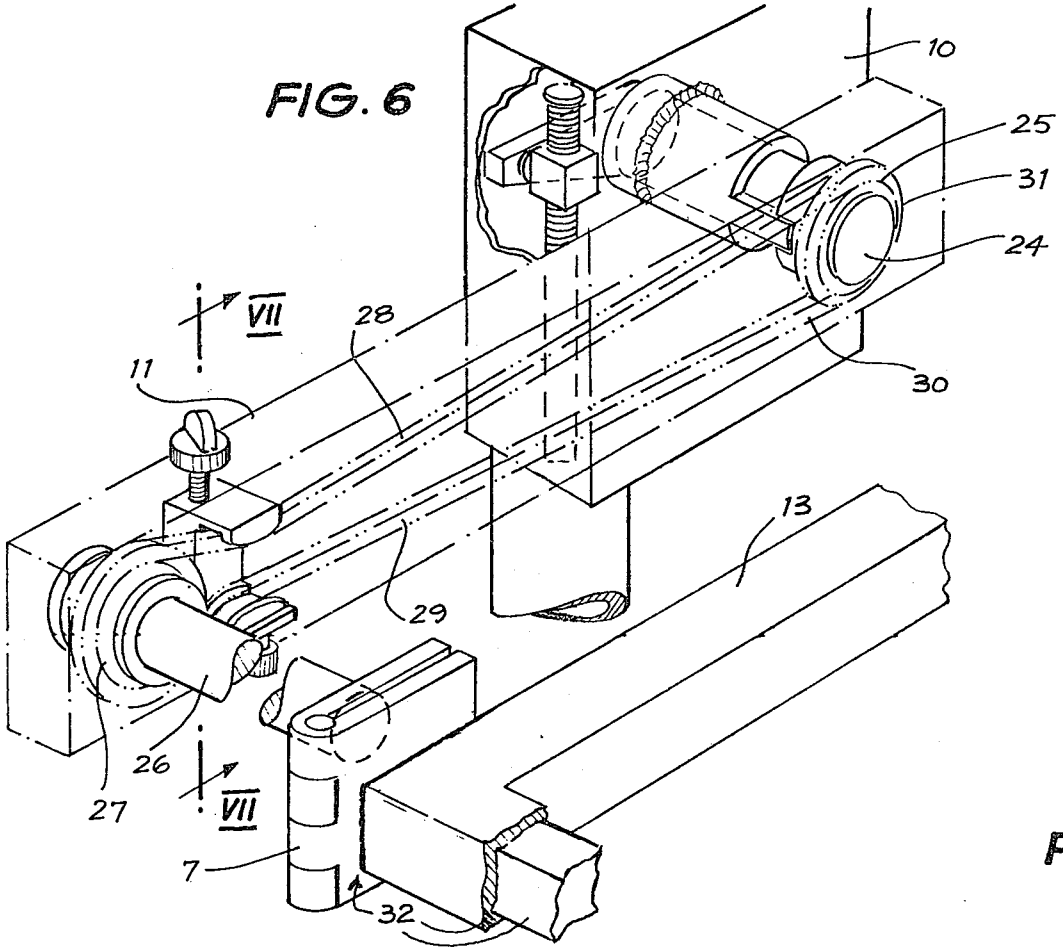
FIG. 6 illustrates the detail of the patient support levelling arrangement.

If the patient holding structure, in this embodiment stretcher 13, were fixedly attached to the arm 11 then as the arm 11 is raised or lowered so the stretcher 13 would be tilted one way or another out of a level position. To prevent this a parallel arm type levelling arrangement is built into the arm 11. One type of such arrangement is shown in FIGS. 6 and 7, and will now be described.

The shaft 24 has a sprocket 25 around it but the sprocket 25 is fixed to the housing 10 and does not rotate with the shaft 24.

At the other end of the arm 11 is mounted a rotatable shaft 26 at right angles to the arm 11, that is, parallel to the shaft 24. This shaft 26 also has a sprocket 27 around it, but fixed thereto so that it rotates with the shaft 26. By placing a chain around these two sprockets, when the arm 11 is pivoted up or down the shaft 26 is rotated by the action of the parallel sides 28 and 29 of the chain 30 which is fixed to the outside centre part 31 of the fixed sprocket 25.

The shaft 26 is attached to one leaf of the hinge 7 and the other leaf is fixedly or detachably fixed to the stretcher 13 at 32 such as by a pin and socket arrangement. Hence as the arm 11 is raised or lowered the shaft 26 rotates to maintain the stretcher 13 in a horizontal position.

Certain adjustments are provided in this levelling mechanism as illustrated in FIG. 7. There are rubbing blocks 34 at least one of which is adjusted by screw 35 to vary the tension on the chain. Another adjustment by screw 36 permits adjusting the rotational position of the shaft 26 which in turn will alter the attitude of the seat portion 15 of the stretcher 13. By this means the seat portion 15 may be tilted backwards, through up to 30° to suit the patient. This is an important feature in that it allows the patient's posture to be varied so that prolonged pressure between the patient and the seat at any point is avoided and so that certain severely handicapped patients are held more securely in the chair.

Figure 9:
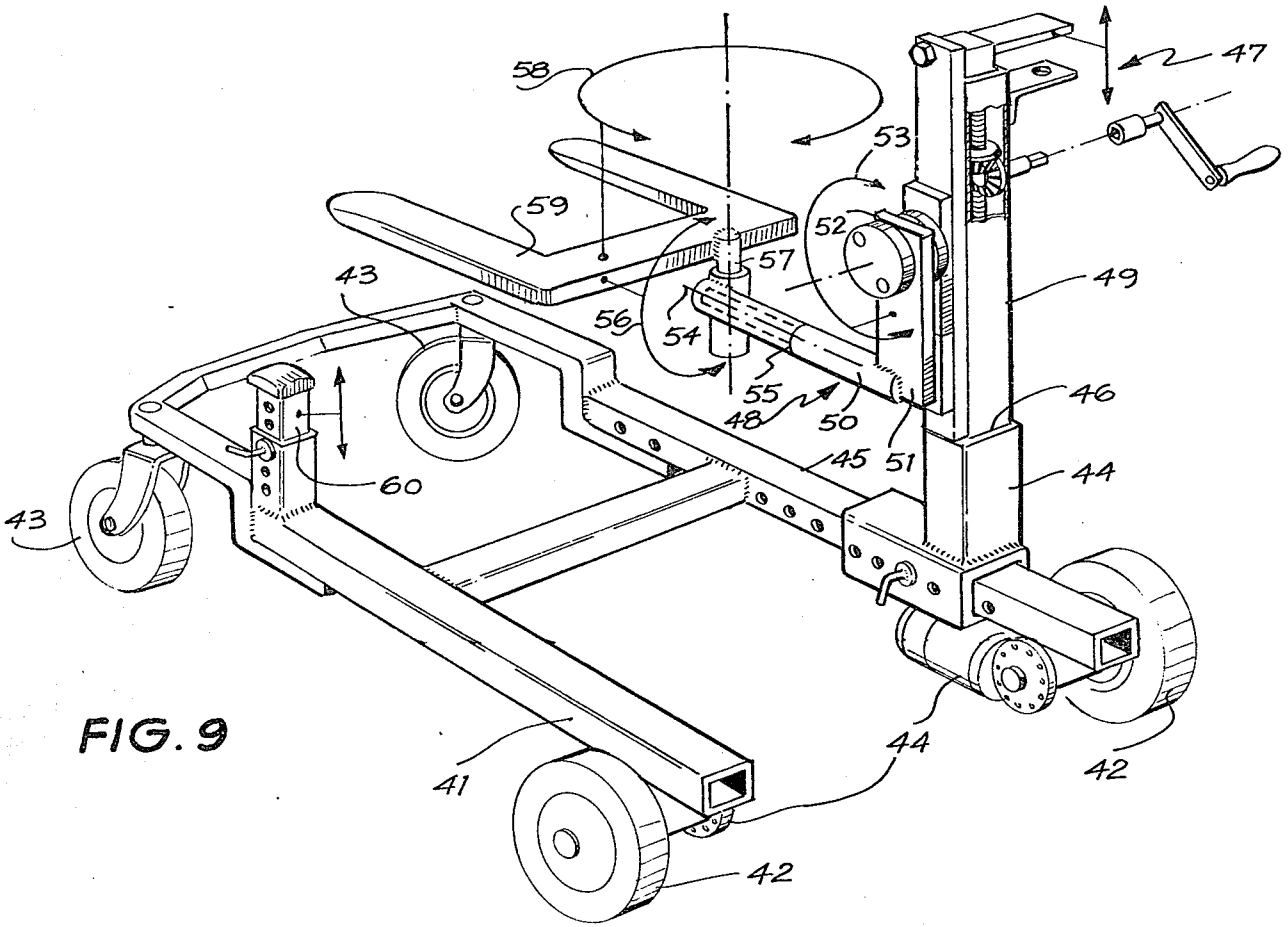
FIG. 9 illustrates a second embodiment of the invention.

Another embodiment of the invention will now be described with reference to FIG. 9.

The base frame 41 would be of any suitable shape, roughly rectangular, with steel or the like members of sufficient strength to cope with the functions of the apparatus. Wheels 42 and 43 or the like would usually be placed in the four corners of the base frame 41 to give best stability. Any or all of the wheels can be made rotatable like castors for steering purposes as required. Power means may be incorporated in the frame 41 to drive the wheels 42 so the apparatus can be self-propelled. This is achieved in one form by electric batteries driving one or more electric motors 44. In one form an electric motor 44 is attached to each of the non-rotatable wheels and by varying the power to either motor a steering effect can be achieved.

The apparatus will work satisfactorily with the upright post 49 on either side of base frame 41. One of the deciding factors as to which side the post is mounted is whether the country of use has left or right hand vehicle steering as this determines from which side the apparatus can be used to place a patient in a vehicle. The post may be either fixedly mounted or removably mounted on the side of the base frame. By making it removably mounted, it may be shifted from one side frame to the other and also it may be removed to allow easier storage of the apparatus and easier transportation for example, in the boot of a vehicle. This removability, in one form is achieved by an adaptor 44A which may slide onto a side member 45 of the base frame 41 and the adaptor has a well 46 into which the post 49 slides and is removably retained.

In the above arrangement as the adaptor 44A may slide to various positions along the side member 45, so that the upright post is also mountable in various positions along that frame.

The upright post 49 has combined therewith lifting means 47 such as rotatable screws, hydraulic jack, etc, and the lifting means may be electrically powered. Attached to the lifting means 47 is moving means 48 which can be raised or lowered by the lifting means 47. The moving means comprises a cantilever arm 50 which may be pivotally attached to the lifting means 47 either directly or through a link arm 51 at the joint 52 such that it is pivotable in a vertical plane (see arrow 53). It may also be rotated on its own axis 54 as at 55 (see arrow 56) and it may also be hinged by pivot 57 so that engaging means 59 folds backwards in a horizontal plane (see arrow 58).

The engaging means 59 are suitable for engaging a patient support structure such as stretcher, sling, seat, etc, as in FIG. 1. These engaging means 59 may take any suitable form such as one or more arms or spigots to engage a stretcher, means to engage a sling, means to engage some type of harness and so on.

The engaging means 59 when pivotable at 57 allows the patient support structure to be rotatable through 90° in a horizontal plane (see arrow 58) so that the structure is lying fore-and-aft the apparatus.

Mounted towards one end of the frame 41 is a vertically adjustable stop arm 60. When an articulated stretcher or the like (see FIGS. 1 to 5) is attached to the engaging means 59 and the engaging means 59 has been moved about its hinge 57 in a horizontal plane so that the stretcher is lying fore-and-aft of the apparatus, the cantilever arm 50 is pivoted downwardly in a vertical plane about its connection 52 to the lifting means 47 so that the stretcher is tilted, back up, front down, and the vertically adjustable stop arm 60 forces the front end of the articulated stretcher upwards, that is, it is not permitted to continue tilting downwards with the result that the stretcher is changed into the configuration of a chair (similar to FIG. 1). Thus the patient in the stretcher would be moved from a horizontal position to a sitting position with legs outstretched. This rotation of the cantilever arm 50 may continue until it is more or less vertical. When the link arm 51 is present and the upright post 49 is moved along the side frame to its rearmost position the engaging means 59 is positioned out from or beyond the end of the support frame 41 after it has been rotated through ninety degrees by rotating the cantilever arm 50 at 55 on its own axis 54. The engaging means with a patient support structure attached may then be lowered into and raised out of a bath or the like.

The height of the base frame 41 is such that it may be moved under a bed or under a motor vehicle so that the cantilever arm 48 together with the engaging means may be positioned over a bed or through an open car door. The rear end of the base frame 41 may be left open so that the frame becomes generally U-shaped thus permitting the apparatus to be positioned around a toilet.

For some operations such as lowering and raising a patient for bathing in a tub the upright post 49 is moved to near the rear end of the side of the base frame. This may lead to some instability so the front end of the base frame 41 would have means for fixing it to the floor so that it would not tip up (see FIG. 4).

The pivotal joint or connection 52 between the moving means 48 and the lifting means 47 may be fixed or disengaged from the lifting means 47 and attached to the post 49 at any suitable height. The lifting means 47 is then free to perform other lifting functions as required. For example, if a vertical extension arm and a cantilever arm are attached to the lifting means this arrangement can be used to lift the patient in various positions.

Figure 10:
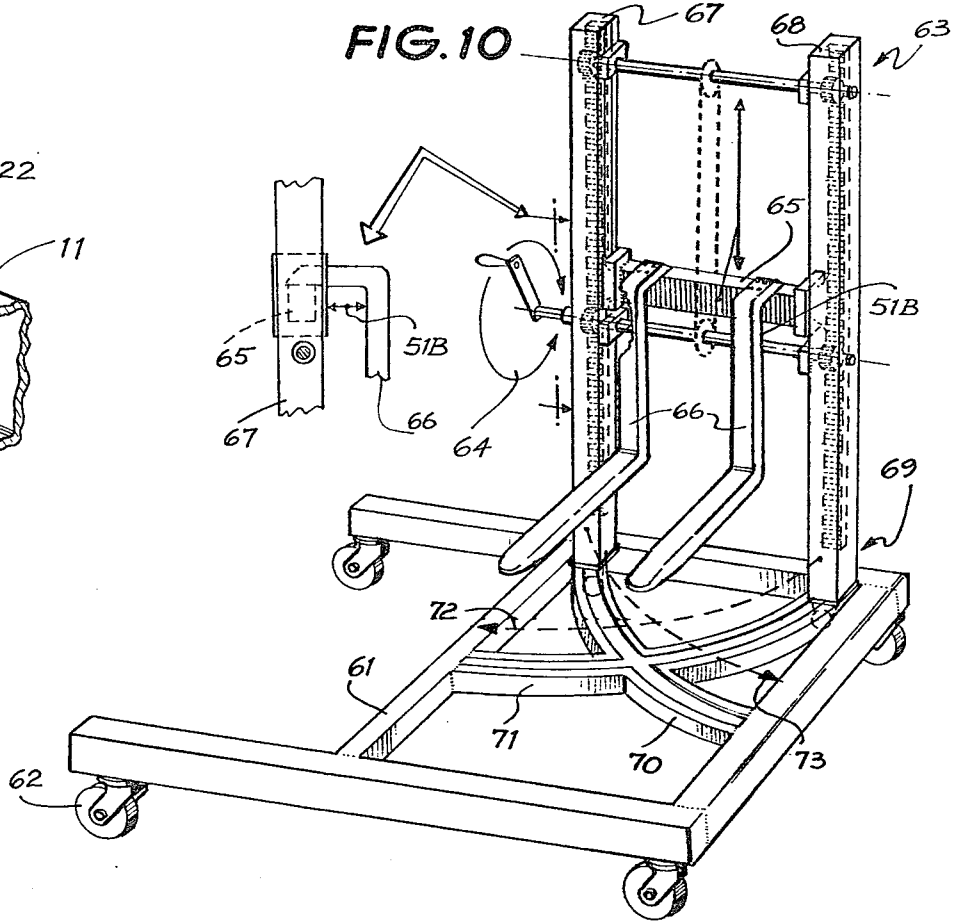
FIG. 10 illustrates a third embodiment of the invention.

A further embodiment will now be described with reference to FIG. 10. This embodiment, like that of FIG. 9 can perform all the operations of that of FIG. 1. The only difference in the working of the apparatus is that the moving means is moved linearly up and down and not by a rotating arm. This is only a difference of form and not of principle.

The base frame 61 has wheels or castors 62 supporting the holding means 63 which comprises lifting means 64 which moves the moving means 65 vertically up and down. Engaging means 66 which may have an off-set 51B are attached to the moving means. The holding means also comprises an upright post which is in two parts 67 and 68. This post 67,68 supports the lifting means 64 and is pivotable with respect to the base frame 61.

The pivot 69 comprises curved tracks 70,71 into which the lower ends of the posts 67,68 are movably mounted. In the position shown in the drawing the post faces the side of the base frame and a support structure such as a stretcher would be positioned fore-and-aft the base frame (wheel chair, toileting and transporting position FIGS. 1 and 5).

The holding means may be moved through ninety degrees in either direction by either anchoring post 67 and moving post 68 along tracks 71 as per the arrow 72 (bedding position FIG. 2 and car loading position FIG. 3) or by anchoring post 68 and moving post 67 along track 70 as per arrow 73 (bathing position FIG. 4).

In conclusion it is pointed out that the transporter of the invention is capable of performing functions (particularly with patients) that were not possible previously with known apparatus. For instance, the transporter can pick a patient up from a bed, take him to a toilet then into a bathtub, then back to the bed. As required the patient may also be transported to and deposited in a motor vehicle. All these operations can be performed without the necessity of moving the patient off the stretcher.

To achieve the above functions the transporter comprises a base frame (1, 41, 61) movably supported by wheels or castors (2, 42, 62) which base frame supports holding means (6, 49, 63) which comprises lifting means (FIG. 8, 47, 64) and pivot mens (7, 57, 69).

What we claim is:

1. For use with a patient support structure, a patient transporter comprising a base frame, wheels or the like fitted to the base frame to support it for movement in at least fore-and-aft directions, and holding means mounted on the base frame to hold the patient support structure above the base frame, wherein the holding means is mounted on one side of the base frame relative to the fore-and-aft directions, and includes lifting means operable in use of the transporter to raise and lower the patient support structure relative to the base frame and pivot means operable in use to enable horizontal rotation of the patient support structure between positions in which it is aligned with and transverse to the said fore-and-aft directions, said lifting means comprising an arm pivotally mounted for swinging movement about a generally horizontal arm pivot axis whereby its end remote from the pivot axis can be raised and lowered by said swinging movement and said pivot means comprises a hinge type joint to mount the patient support structure on said remote end of the arm and defining an upright hinge axis about which said horizontal rotation of the patient support structure is executed.

2. A transporter for patients, comprising a patient support structure; a base frame; wheels or the like fitted to the base frame to support it for movement in at least fore-and-aft directions; and holding means mounted on one side of the base frame relative to the fore-and-aft directions to hold the patient support structure above the base frame; wherein the patient support structure is in the form of a combination chair/stretcher comprised of a plurality of panels hinged together and capable of relative angular adjustment, while the support structure is held by the holding means, between positions in which they define an elongate substantially flat stretcher and positions in which they define a chair having at least a seat portion and a back rest portion, and the holding means comprises lifting means operable in use of the transporter to raise and lower the patient support structure relative to the base frame and pivot means to enable horizontal rotation of the patient support structure, when held by the holding means, between positions in which it is aligned with or transverse to the said fore-and-aft directions; wherein, in use of the transporter, a patient supported on said patient support structure can be moved between positions aligned with and transverse to said fore-and-aft directions and can in either of those positions be supported in either a prone or a seated condition.

3. A transporter for patients comprising a patient support structure, a base frame, wheels or the like fitted to the base frame to support it for movement in at least fore-and-aft directions, and holding means mounted on the base frame to hold the patient support structure above the base frame, characterized in that the holding means is mounted at one side of the base frame relative to the fore-and-aft directions and wherein the holding means comprises lifting means operable in use of the transporter to raise and lower the patient support structure relative to the base frame, said lifting means comprising an arm pivotally mounted on an upper part of said holding means for swinging movement about a generally horizontal, arm pivot axis whereby its end remote from the pivot axis can be raised and lowered by said swinging movement; and pivot means to allow horizontal rotation of the patient support structure between positions in which it is aligned with or transverse to the said fore-and-aft directions, said pivot means comprising a hinge to mount the combination chair and stretcher on said remote end of the arm and defining an upright hinge axis about which said horizontal rotation of the patient support means is executed; and wherein the patient support structure is in the form of a combination chair/stretcher comprised of a plurality of panels hinged together for relative movement between positions in which they define an elongate substantially flat stretcher and positions in which they define a chair having at least a seat portion and a back rest portion.

4. A transporter for patients comprising a patient support structure, a base frame, wheels or the like fitted to the base frame to support it for movement in at least fore-and-aft directions, and holding means mounted on the base frame to hold the patient support structure above the base frame characterized in that the holding means is mounted at one side of the base frame relative to the fore-and-aft directions and wherein the holding means comprises lifting means operable in use of the transporter to raise and lower the patient support structure relative to the base frame and pivot means to allow horizontal rotation of the patient support structure between positions in which it is aligned with or transverse to the said fore-and-aft directions, and wherein the patient support structure is in the form of a combination chair/stretcher comprised of a plurality of panels hinged together for relative movement between positions in which they define an elongate substantially flat stretcher, positions in which they define a chair having at least a seat portion and a back rest portion, and a continuum of positions intermediate said stretcher positions and said chair positions, said panels selectively maintainable in said stretcher positions, said chair positions, and said continuum of intermediate positions by operation of power control means to maintain rigid angles between said panels.

5. A transporter as claimed in claim 1 or 2 wherein the holding means for the patient support structure comprises adjustment means operable to vary the preset attitude of the patient support structure relative to the base frame.

6. A transporter as claimed in claim 4 wherein said power control means is formed integral with said transporter.

7. For use with a patient support structure, a patient transporter comprising a base frame, wheels or the like fitted to the base frame to support it for movement in at least fore-and-aft directions, and holding means mounted on the base frame to hold the patient support structure above the base frame characterized in that the holding means is mounted at one side of the base frame relative to the fore-and-aft directions and wherein the holding means comprises lifting means operable in use of the transporter to raise and lower the patient support structure relative to the base frame, said lifting means comprising an arm pivotally mounted on an upper part of said holding means for swinging movement about a generally horizontal arm pivot axis whereby its end remote from the pivot axis can be raised and lowered by said swinging movement; and pivot means to allow horizontal rotation of the patient support structure between positions in which it is aligned with or transverse to said fore-and-aft directions, said pivot means comprising a hinge to mount the combination chair and stretcher on said remote end of the arm and defining an upright hinge axis about which said horizontal rotation of the patient support means is executed.

8. A transporter as claimed in claim 7 or 3 characterized in that the holding means further comprises patient support structure attitude control means to maintain a preset attitude of the patient support structure relative to the base frame as said arm is swung up and down about the generally horizontal arm pivot axis.

9. A transporter as claimed in claim 8, characterized in that the attitude control means comprises a parallel motion mechanism interconnected between said hinge and the pivot end of the arm.

10. A transporter as claimed in claim 9, characterized in that said parallel motion mechanism comprises a fixed sprocket disposed about the arm pivot axis, a further sprocket fixed to the hinge and mounted at said remote end of the arm for rotation relative to the arm about a horizontal pivot axis transverse to the arm, and a chain linking said two sprockets.

11. A transporter as claimed in claim 7 or 3, characterized in that said horizontal, arm pivot axis is located in the vicinity of one end of the base frame in the fore-and-aft directions and the arm is swingable up and down about said generally horizontal arm pivot axis between raised and lowered positions while extending above said one side of the base frame and generally toward the other end of the base frame.

12. A transporter as claimed in claim 11, characterized in that the arm is also pivotable about an upright pivot axis in the vicinity of said one end of the base frame whereby it can be swung about that axis to extend transversely across said one end of the base frame with the horizontal arm pivot axis then being generally aligned with the fore-and-aft directions to permit the arm to be swung up and down in its transverse orientation and with the patient support structure oriented in the transverse direction and projecting beyond said one end of the base frame.

13. A transporter as claimed in claim 12, characterized in that said holding means comprises an upright post fixed to the base frame and a turret member mounted on the post for rotation about the said upright pivot axis and the arm is pivotally connected to the turret member by a pivot defining the generally horizontal arm pivot axis.

14. A transporter as claimed in claim 1 or 2 wherein there is releasable connection means for detachably connecting the patient support structure to the holding means.

15. A transport as claimed in claim 14 wherein the releasable connection means is a pin and socket arrangement.

16. A patient transporter as claimed in claim 1 or 2 wherein the lifting means comprises gears and a crank for manual operation.

17. A patient transporter as claimed in claim 1 or 2 wherein the lifting means and/or the wheels are electrically operated.

18. A patient transporter as claimed in claim 1 or 2 wherein the holding means comprises an upstanding member which is rotatable with respect of the base frame so that the patient support structure can be rotated in a horizontal plane between positions in which it is aligned with or transverse to the said fore-and-aft directions.

19. A patient transporter as claimed in claim 15 wherein the holding means comprises an upstanding member and the pivot means forms the connection between the member and the base frame.

20. A patient transporter as claimed in claim 9 characterized in that the post is in the form of a framework having upright channel sections.

21. A patient transporter as claimed in claim 20 characterized in that the pivot means comprises two intersecting quadrant tracks mounted on the base frame and adapted to support the holding means such that the holding means can be held in one track and pivoted along the other and vice versa so that the holding means can be turned into both the fore and aft directions.

22. A patient transporter as claimed in claim 1 or 2 wherein all the wheels are castor type and the base frame of the transporter may be moved under a bed or the like in either a fore-and-aft direction or a sideways direction.

23. A patient transporter as claimed in claim 1 or 2 wherein one pair of wheels at the fore or aft end are small enough to allow the base frame to be moved under an automobile.

24. A patient transporter as claimed in claim 1 or 2 wherein the holding means is detachable from the base frame for ease of storage and transport.

* * * * *